United States Patent [19]

Yamaguchi

[11] Patent Number: 4,753,608

[45] Date of Patent: Jun. 28, 1988

[54] ELECTRICAL CONNECTOR AND ITS TERMINATION METHOD

[75] Inventor: Masao Yamaguchi, Tokyo, Japan

[73] Assignee: Hirose Electric Co., Ltd., Tokyo, Japan

[21] Appl. No.: 96,495

[22] Filed: Sep. 15, 1987

[30] Foreign Application Priority Data

Sep. 30, 1986 [JP] Japan ..... 61-232837

[51] Int. Cl.[4] ..... H01R 4/24

[52] U.S. Cl. ..... 439/395; 439/417

[58] Field of Search ..... 439/391–419

[56] References Cited

U.S. PATENT DOCUMENTS 4,019,800 4/1977 Loes ..... 439/395

4,175,818 11/1979 Kourimsky et al. ..... 439/395

*Primary Examiner*—Joseph H. McGlynn

*Attorney, Agent, or Firm*—Takeuchi Patent Office

[57] ABSTRACT

An electrical connector for terminating two or more layers of conductors includes an insulating housing having a plurality contacts mounted therein and, on opposite ends, a pair of latch arms with a latch opening, and first and second cable retainer members. The first retainer member has on opposite ends a pair of latch bosses for engagement with the latch openings to latch the first and second retainer members to the insulating housing. The second retainer member has on opposite ends two pairs of latch bosses for engagement with the openings to temporarily mount the first and second retainer members on the insulating housing. This temporary mounting device permits easy replacement of a cable before complete termination of the cable.

11 Claims, 7 Drawing Sheets

ELECTRICAL CONNECTOR AND ITS TERMINATION METHOD

BACKGROUND OF THE INVENTION

The present invention relates generally to multiconductor electrical connectors and, more particularly, to an electrical connector with a plurality of layers of termination sections for high density connection and its termination method.

Japanese Patent Kokai No. 60-167,285, assigned to the assignee of the present application, discloses a multiconductor electrical connector of the aforementioned type. This electrical connector has at least two types of contacts having different lengths, the piercing portions of which project from a front end of an insulating housing in at least two rows, and at least two cable retainer sections; the first cable retainer section receives the ends of the first flat multiconductor cable in the piercing portions of the shorter contacts and the second cable retainer section receiving the ends of the second multiconductor flat cable in the piercing portions of the longer contacts upon the first cable retainer section. This structure permits the termination of most commonly used multiconductor flat cables at least two layers, thus doubling the contact mounting density.

However, this electrical connector has the following drawbacks.

(1) A plurality of cable retainer members are separated before cable termination so that each multiconductor flat cable must be terminated separately to the corresponding cable retainer in order by using a solderless connection machine. Consequently, the number of steps of termination operation is large, pushing up the manufacturing cost.

(2) To insert an end of each cable into a cable retainer section, the cable retainer section must be mounted in an appropriate solderless connection tool. Consequently, a large number of such special solderless connection tools are required for mass production, resulting in the increased manufacturing cost.

(3) The cable retainer members can be used for only multiconductor flat cables and cannot be used for individual separate conductors of a round cable, etc.

SUMMARY OF THE INVENTION

Accordingly, it is an object of the present invention to provide an electrical connector which is free of the above problem and its termination method.

According to one aspect of the invention there is provided an electrical connector for terminating at least two layers of conductors, which includes an insulating housing having a higher top surface and a lower top surface; a plurality of longer contacts with their piercing portions projecting from the higher top surface; a plurality of shorter contacts with their piercing portions projecting from the lower top surface; a first retainer member adapted to be mounted on the higher top surface; a second retainer member adapted to be mounted on the lower top surface; a device for temporarily mounting the first and second retainer members so that the first and second layers of conductors are held adjacent to the piercing portions of the longer and shorter contacts; and a device for latching the first and second retainer members to the insulating housing so that the first and second layers of conductors are connected to the longer and shorter contacts, respectively, when the first and second retainer members are further pushed toward the insulating housing.

According to another aspect of the invention there is provided a method of terminating at least two layers of individual conductors to an electrical connector which includes an insulating housing having a higher top surface and a lower top surface, a pair of rows of longer contacts with their piercing portion projecting from the top surface, and a pair of rows of shorter contacts with their piercing portions projecting from the lower top surface, which includes the steps of preparing a first retainer member adapted to be mounted on the higher top surface of the insulating housing; preparing a second retainer member adapted to be mounted on the lower top surface of the insulating housing; placing first and second layers of conductors on the first and second retainer members, respectively; mounting the second retainer member on the first retainer member so that the first layer of conductors is held between them; temporarily mounting the first and second retainer members to the insulating housing in such a manner that the first and second layers of conductors may be held adjacent to the piercing portions of the longer and shorter contacts, respectively; and further pushing down the first and second retainer members toward the insulating housing so that the first and second layers of conductors are connected by piercing to the longer and shorter contacts, respectively.

The terms "layers of conductors" herein used cover both layers of multiconductor flat cables and layers of individual conductors.

other objects, features, and advantages of the invention will be apparent from the following description taken in conjuction with the accomapnying drawings.

DESCRIPTION OF THE PREFERRED EMBODIMENTS

Figure 1:
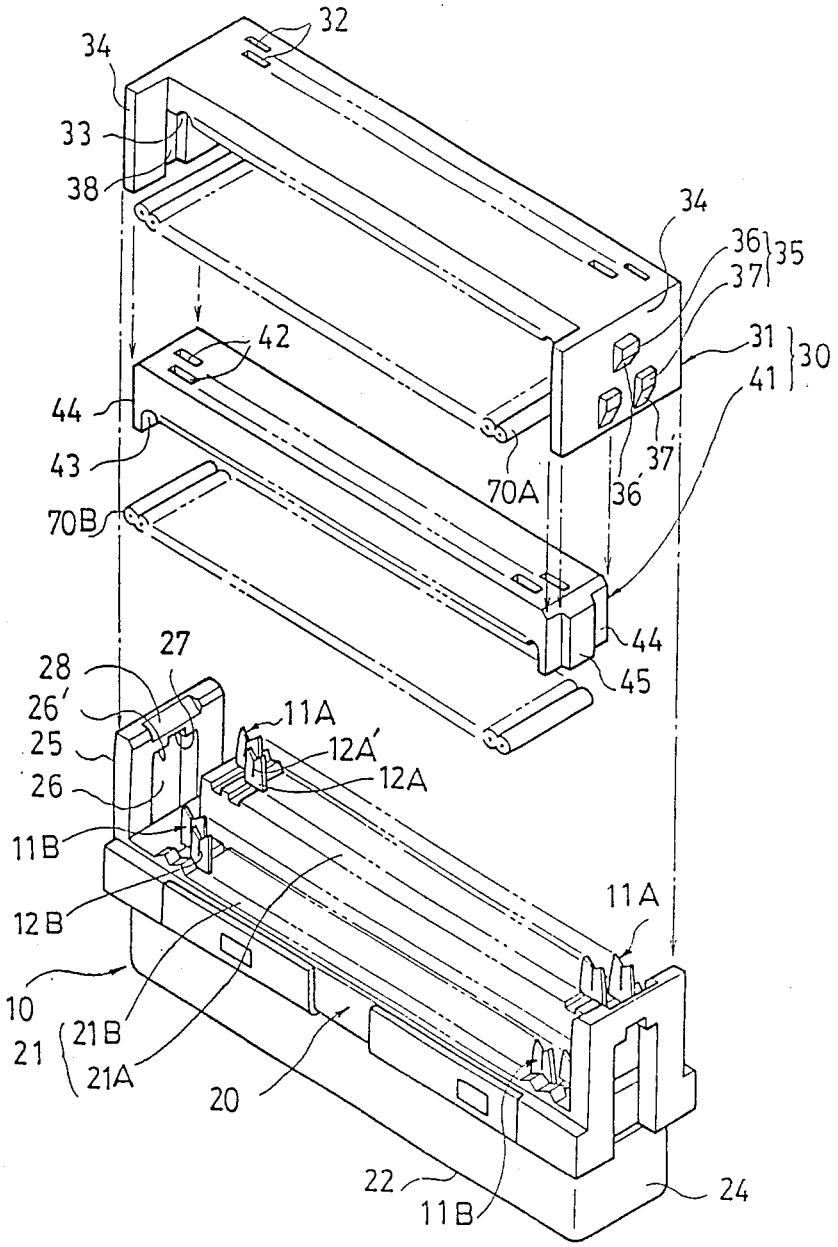
FIG. 1 is an exploded perspective view of an electrical connector for terminating a pair of multiconductor flat cables according to the invention.

FIG. 1 shows, in an exploded perspective view, an electrical connector to which a pair of multiconductor flat cables can be connected by solderless connection or insulation displacement techniques. The electrical connector consists of a connector block 10, and first and second cable retainer members 31 and 41. The connector block 10 consists of an insulating housing 20, and longer and shorter contacts 11A and 11B mounted in the insulating housing 20.

Figure 4:
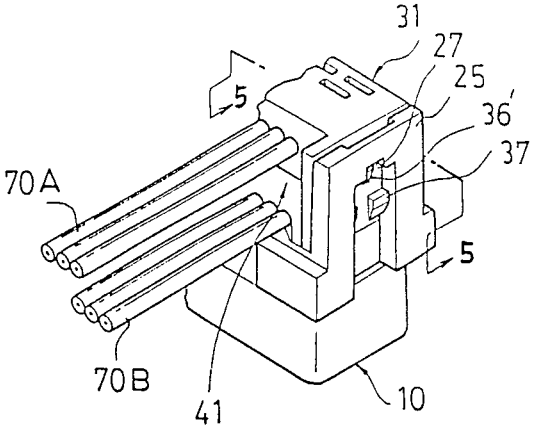
FIG. 4 is a perspective view of part of the electrical connector of FIG. 1 in a complete termination position.

As best shown in FIG. 4, each contact 11A has a piercing portion 12A, a contacting portion 13A, and a bent portion 14A. The piercing portion 12A is bifurcated in a V-shape form for easy reception of a conductor. A slit 12A' extends downwardly from the bottom of the V-shaped cut, into which a conductor is pushed for connection (see FIG. 1). The contacting portion 13A has a tuning fork shape for receiving the contacting portion of a mating contact. The bent portion 14A is formed between the piercing portion 12A and the contacting portion 13A in such a manner that the plane of the piercing portion 12A may become substantially perpendicular to the plane of the contacting portion 13A. The contact 11B is identical with the contact 11A except that it is shorter than the contact 11A and, therefore, its detailed description will be omitted.

Figure 6:
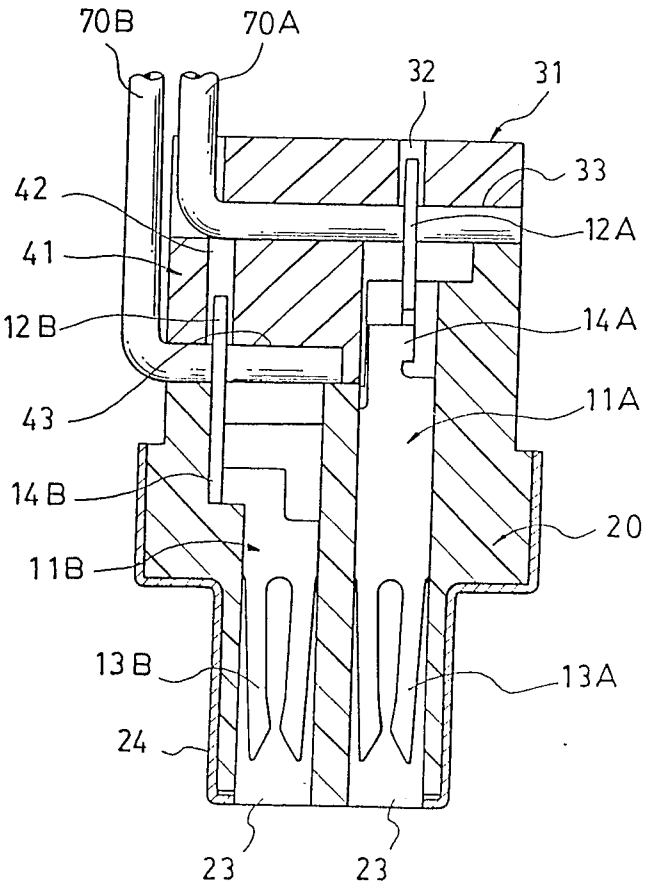
FIG. 6 is a sectional view of the electrical connector of FIG. 1 to which the first and second multiconductor flat cables are terminated.

As best shown in FIG. 1, the insulating housing 20 is made of a plastic or other insulating material in such a manner that its top surface 21 may consist of a higher top surface 21 and a lower top surface 21B. A pair of rows of the piercing portions 12A of longer contacts 11A project from the higher top surface 21A in a staggered fashion and a pair of rows of the piercing portions 11B of shorter contacts 12B project from the lower top surface 21B in a staggered fashion. As best shown in FIG. 6, these contacts 11A and 11B are mounted in a pair of rows of receiving apertures 23 extending across opposite surfaces 21 and 22. A metal case 24 is provided for shield connection.

The connector block 10 has an opposite ends a pair of latch arms 25 for engagement with latch bosses 35 of the first retainer member 31 to lock the retainer members 31 and 41 to the connector block 10. Each latch arm 25 has a rectangular opening 26 for receiving the latch bosses 35. A latch notch 27 is provided in the middle of the upper side of the opening 26 for receiving the first or upper latch boss 36. On either side of the latch notch 27 there are provided latch shoulders 26' for engagement with the second latch bosses 37. On an uper edge of the latch arm 25 there is provided a sloped surface 28 for easy insertion of the latch bosses 35. These latch arms 25 are also adapted to latch retainer members 51 and 61 which will be described later herein.

The retainer block 30 consists of the first and second retainer members 31 and 41 for holding the ends of multiconductor flat cables 70A and 70B. These retainer members 31 and 41 are made of a plastic or other insulating material. The first or upper retainer member 31 has a pair of rows of receiving apertures 32 through which the piercing portions 12A of contacts 11A are passed. A plurality of parallel grooves 33 are provided on the lower surface of the first retainer member 31 for receiving respective conductors of the first multiconductor flat cable 70A. The first retainer member 31 has on opposite ends a pair of end walls 34, each having on its outside the first latch boss 36 with a lower sloped surface 36' and a pair of second or lower latch bosses 37 with a lower sloped surface 37' below the first latch boss 36. These first and second latch bosses constitute latch bosses 35. On the inside of each end wall 34 there is provided a guide channel 38 into which a guide rim 45 of the second retainer member 41 is fitted as described hereinafter. Preferably, the widths of these guide rims on opposite ends are made different so as to prevent wrong fitting into the guide channel of the second retainer member 41.

Similarly, the second retainer member 41 has a pair of rows of receiving apertures 42 through which the piercing portions 12B of contacts 11B are passed. On the lower surface of the second retainer member 41 there are provided a plurality of parallel grooves 43 for receiving the ends of conductors of the second multiconductor flat cable 70B. The second retainer member 41 has on opposite ends 44 a pair of guide rims 45 at positions corresponding to the guide channels 38 of the first retainer member 31.

A method of terminating first and second multiconductor flat cables 70A and 70B to the connector block 10 by means of the retainer block 30 will be described.

(1) The ends of conductors of the first multiconductor flat cable 70A are placed in the parallel grooves 33 of the first retainer member 31 which has been set upside down so that its lower surface faces up.

(2) The second retainer member 41 is mounted upon the first retainer member 31, with its lower surface facing up, so that its guide rims 45 may be fitted into the guide channels 38. Then, the ends of conductors of the second multiconductor flat cable 70B are placed in the parallel grooves 43. Alternatively, the first and second multiconductor flat cables 70A and 70B may be placed separately in the first and second retainer members 31 and 41, respectively, before the first and second retainer members are put together. This permits production on the assembly line, thus making mass production possible.

Figure 2:
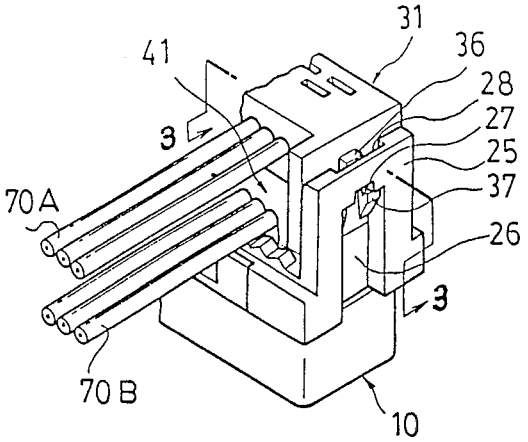
FIG. 2 is a perspective view of part of the electrical connector of FIG. 1 in a temporary mounting position.
Figure 3:
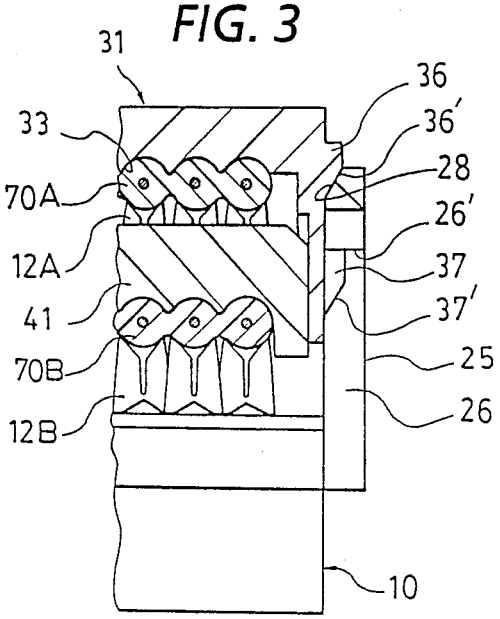
FIG. 3 is a sectional view taken along the line 3—3 of FIG. 1.

(3) The retainer block 30 thus assembled is temporarily put together with the connector block 10 by hand, as shown in FIGS. 2 and 3, so that the sloped surface 37' of the second latch boss 37 on the first retainer member 31 abuts the sloped surface 28 of the latch arm 25 of the connector block 10. As the retainer block 30 is further pushed down, the second latch bosses 37 pass the sloped surface 28 while pushing outwardly the latch arms 25 and reach the latch opening 26. At this point, the latch arms 25 spring back to the original positions so that the second latch bosses 37 engage the shoulders 26' to temporarily hold the first multiconductor flat cable 70 between the parallel grooves 33 and the piercing portions 12A of the contacts 11A as shown in FIG. 3. Similarly, the second multiconductor flat cable 70B is temporarily held between the parallel grooves 43 of the second retainer member 41 and the piercing portions 12B of the contacts 11B. In this way, the retainer block 30 is temporarily put together with the connector block 10 in such a condition that the solderless connection or termination is not completed. In this condition, no cables will fall off from the retainer block 30 so that the loaded retainer block may be conveniently transported or stored for a long period of time.

Figure 5:
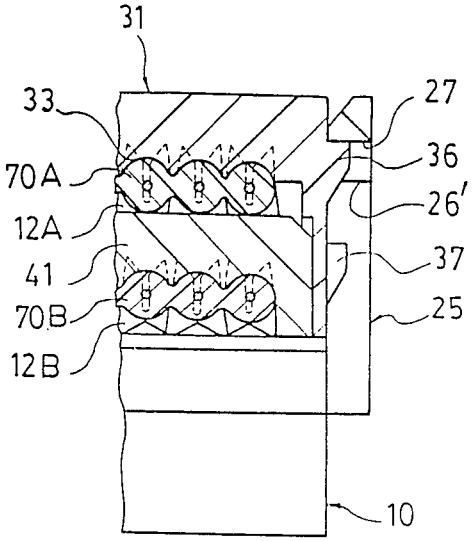
FIG. 5 is a sectional view taken along the line 5—5 of FIG. 3.

(4) Finally, the temporarily fixed electrical connector is set face down or up and pressed in a press machine (not shown), so that not only the conductors of each multiconductor flat cable are connected by piercing to the piercing portions of the corresponding contacts but also the first latch bosse 36 of the first retainer member 31 passes over the upper edge of the latch arm 25 and engages the latch notche 27 to secure the retainer block 30 to the connector block 10 as shown in FIGS. 4, 5, and 6. Thus, the termination of the multiconductor flat cables to the electrical connector is completed.

A temporary assembly of the retainer block 30 and the connector block 10 as described in the above paragraph (3) is so easy to dissemble either by hand or with a simple tool that any of the cables may be conveniently replaced with another one when the wrong cable is assembled or the cable is to be changed. Although, in the above embodiment, the latch bosses 35 are provided on the end walls of the first retainer member 31 and the second retainer member 41 is fitted between these end walls, the second retainer member may be provided with a pair of end walls with latch bosses provided thereon, and the first retainer member is put together with the second retainer member. In addition, although the connector block has a pair of latch arms with an opening and the retainer block has a pair of sets of bosses, these provisions may, of course, be exchanged.

Figure 7:
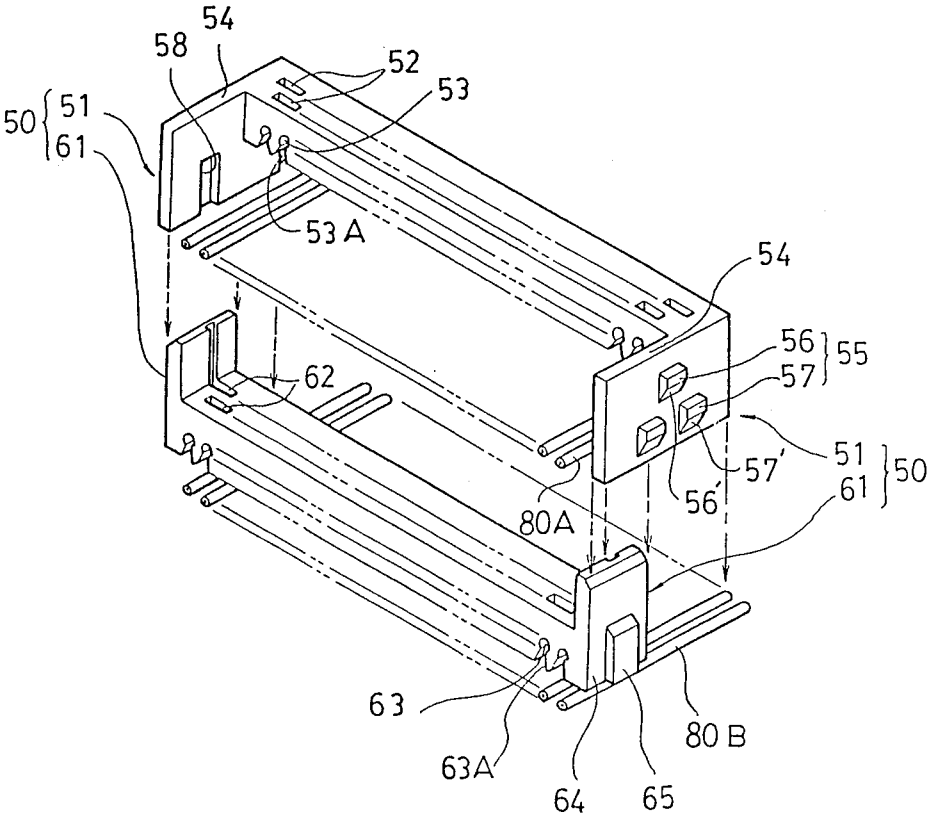
FIG. 7 is an exploded perspective view of another retainer bloke according to the invention.

FIG. 7 shows another embodiment of the retainer block of an electrical connector according to the invention. This electrical connector is adapted to be connected by piercing to separate individual conductors or wires. A connector block of this connector is identical with the connector block 10 of FIG. 1 and, therefore, its detailed description will be omitted.

A retainer block 50 consists of the first retainer member 51 for receiving the ends of conductors of the first set and the second retainer member 52 for receiving the second set of conductors. These retainer members are made of a plastic or other insulating material. Like the first retainer member 31 of the above first embodiment, the first retainer member 51 has a pair of rows of receiving apertures 52 through which the piercing portions 12A of contacts 11A are passed. On the lower surface of the first retainer member 51 there are provided parallel grooves 53 at predetermined intervals for receiving the respective conductors 80A of the first set. Each parallel groove 53 has a pair of sloped end walls 53A for easy reception of a conductor. The first retainer member 51 has on opposite ends a pair of end walls 54, on the outside of which there are provided the first latch boss 56 with a lower sloped surface 56' and the second latch bosses 57 with a sloped surface 57' below the first one. On the inside of the end wall 54 there is provided a guide channel 58 into which a guide rim 65 of the second retainer member 61 is fitted as hereinafter described. Preferably, the widths of the guide channels 58 are made different so as to prevent wrong fitting of the second retainer member 61 into the first retainer member 51.

Like the first retainer member 51, the second retainer member 61 has a pair of rows of receiving apertures 62 through which the piercing portions 12B of contacts 11B are passed and, on its lower surface, a plurality of parallel grooves 63 at the positions in alignment with the receiving apertures 62 for receiving the ends of conductors 80B of the second set. Each parallel groove 63 has a pair of sloped end walls 63A for easy reception of a conductor. On the outside of each end wall 64 there is provided a guide rim 65 to fit into the guide channel 58 of the first retainer member 51.

A method of terminating the first and second sets of conductors 80A and 80B to the connector block 10 (FIG. 1) by means of the retainer block 50 will be described.

(1) Individual conductors 80A are placed in the parallel grooves 53 of the first retainer member 51 which has been set upside down, with the lower surface facing up.

(2) The second retainer member 61 is put, upside down, together with the first retainer member 51 so that its guide rims 65 are fitted into the guide channels 58 on the inside of the end walls 54. Respective conductors 80B of the second set are then placed in the parallel grooves 63. Alternatively, individual conductors 80A and 80B may first be placed in the first and second retainer members, respectively, and then these retainer members are put together. This permits production on the assembly line, making mass production possible.

(3) The retainer block 50 consisting of the first and second retainer members 51 and 61 is temporarily mounted on the connector block 10 by hand so that the sloped surfaces 57' of the second latch bosses 57 abut the sloped surfaces 28 of the latch arms 25 of the connector block 10. As the retainer block 50 is further pushed down, the second bosses 57 pass the sloped surfaces 28 while pushing outwardly the latch arms 25 and reach the openings 26. At this point, the latch arms 25 spring back to their original positions so that the second latch bosses 57 engage the latch surface 26'. Thus, the individual conductors 80A of the first set are temporarily held adjacent to the piercing portions 12A of contacts 11A. Similarly, the individual conductors 80B of the second set are temporarily held adjacent to the piercing portions 12B of contacts 11B. Thus, the retainer block 50 is temporarily mounted in the connector block 10 in such a condition that the individual conductors are not completely terminated to the connector block. In this condition, the retainer block 50 may conveniently be transported or stored for a long time without dropping any conductor from the retainer block.

Figure 8:
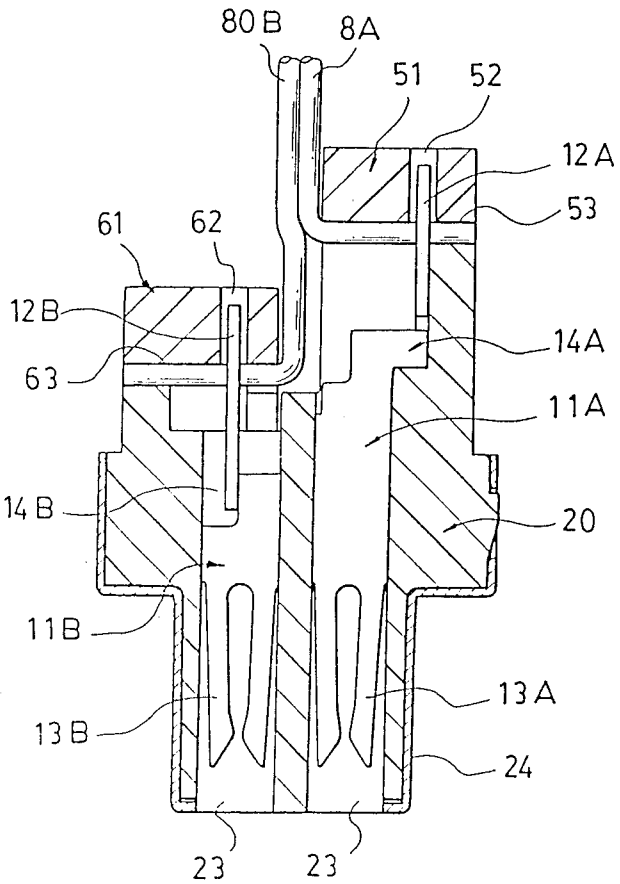
FIG. 8 is a sectional view of the electrical connector of FIG. 7 to which individual conductors have been terminated.

(4) Finally, the temporarily assembled electrical connector is set face either up or down and pressed in a press machine (not shown) so that not only the individual conductors are connected by piercing to the piercing portions of contacts but also the first latch bosses 56 of the first retainer member 51 pass over the upper edge of the latch arms 25 and engage the latch notches 27 to secure the retainer block 50 to the connector block 10, as shown in FIG. 8. Thus, the termination of the two layers of individual conductors to the electrical connector is completed.

Figure 9:
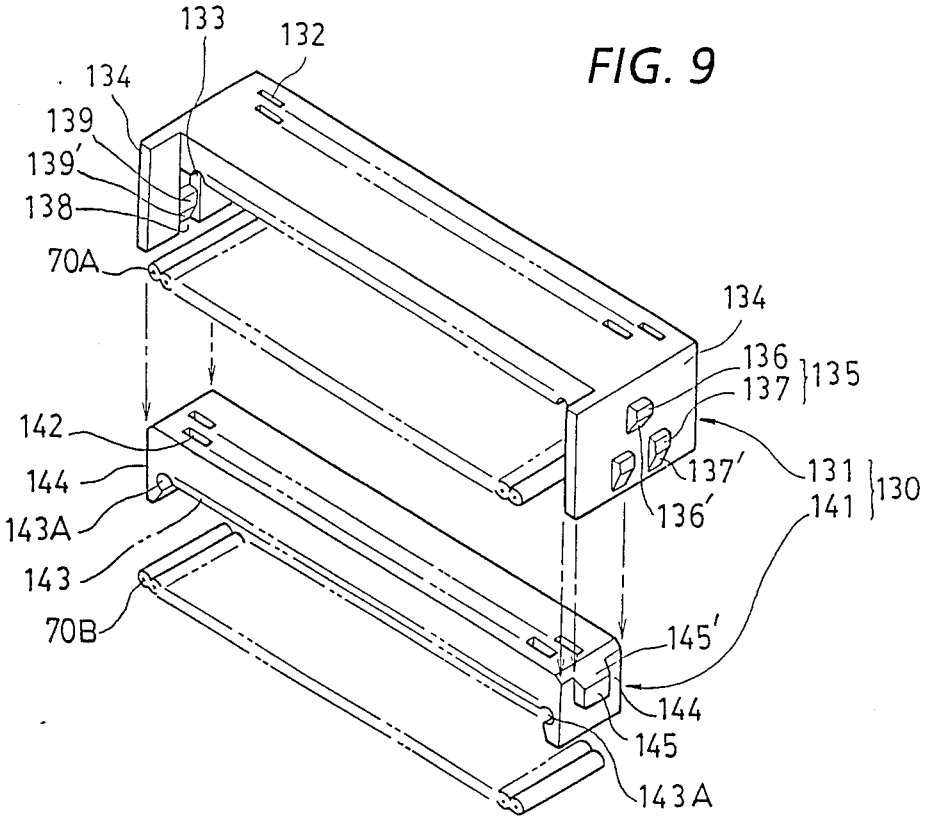
FIG. 9 is an exploded perspective view of still another retainer block according to the invention.

FIG. 9 shows a still another embodiment of the retainer block of an electrical connector according to the invention. This retainer block is to be put together with a connector block identical with that of FIG. 1. Its structure is almost the same as that of FIG. 1 and, therefore, its detailed description will be omitted except that its parts are given reference numerals each consisting of 100 plus the corresponding reference numeral of FIG. 1. A retainer block 130 is adapted to fixedly hold both multiconductor flat cables 70A and 70B so that the retainer block loaded with the flat cables may be transported or stored without temporarily mounting it in the connector block 10. For this reason, the second retainer member 141 has a pair of retention grooves 143A for holding the multiconductor flat cable 70B.

In each guide channel 138 on the inside of an end wall 134 there is provided a latch protuberance 139 for engagement with a guide rim 154 on the side of the second retainer member 141 to secure the second retainer member 141 to the first retainer member 131. The latch protuberance 139 has a lower sloped surface 139' in cooperation with upper the sloped surface 145' of the guide rim 145 for easy fitting of the second retainer member 141 into the first retainer member 131. The retainer block 130 with such a structure is able to hold the first and second multiconductor flat cables 70A and 70B without temporarily mounting it in the connector block 10 so that it itself can be conveniently transported or stored. A method of assembling the retainer block 130 with the connector block 10 for complete is the same as that of the above first embodiment and, therefore, its detailed description will be omitted.

Figure 10:
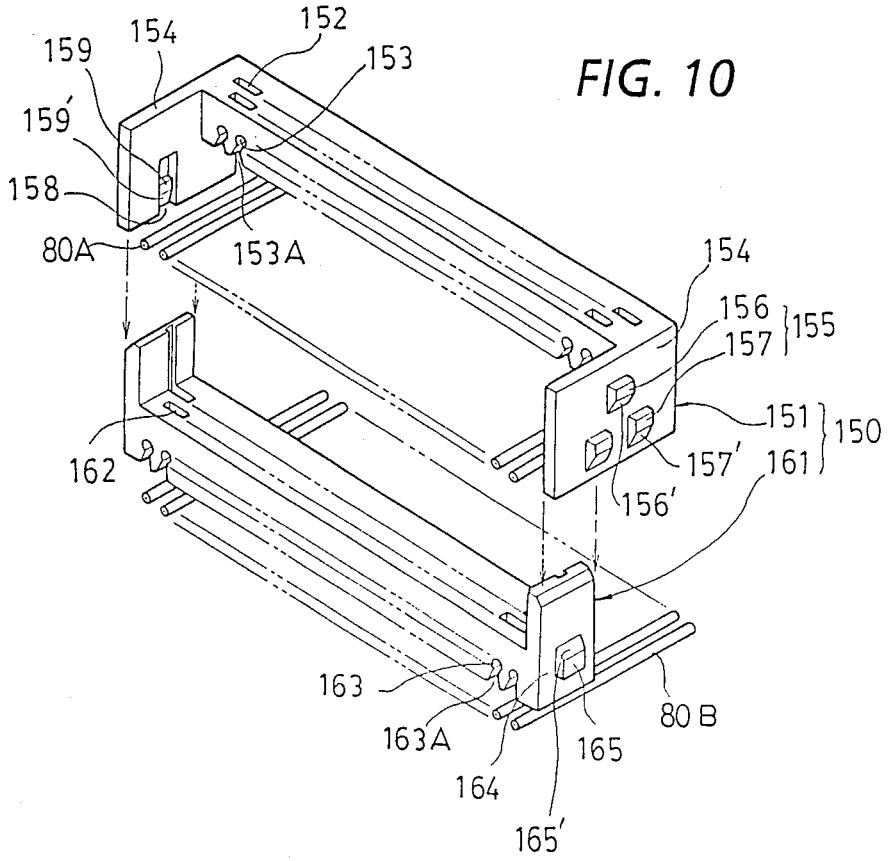
FIG. 10 is an explosed perspective view of yet another retainer block according to the invention.

FIG. 10 is yet another embodiment of the retainer block of an electrical connector according to the invention. This retainer block is adapted to be assembled with a connector block which is identical with the connector block 10 of FIG. 1. The structure is substantially identical with that of the retainer block 50 of FIG. 7 and, therefore, its detailed description will be omitted, except that each part is given a reference numeral made up of the corresponding reference numeral of FIG. 7 plus 100. A retainer block 150 is able to secure a pair of sets of individual conductors 80A and 80B so that the retainer block loaded with the individual conductors can be transported or stored without temporarily mounting it in the connector block 10. The first retainer member 151 has on opposite ends a pair of end walls 154, each having a guide channel 158 provided with a latch protuberance 159 for engagement with a guide rim 165 to secure the second retainer member 161 to the first retainer member 151. The latch protuberance 159 has a lower sloped surface 159' in cooperation with the upper sloped surface 165' of the guide rim 165 for easy insertion of the second retainer member 161 into the first retainer member 151. The retainer block 150 thus made is able to hold the first and second sets of individual conductors 80A and 80B without making temporary mounting in the connector block 10 so that it is possible to transport or store the loaded retainer block without difficulties. A method of assembling the retainer block 150 with the connector block 10 for complete termination is the same as that of the above second embodiment and, therefore, its detailed description will be omitted.

Figure 11:
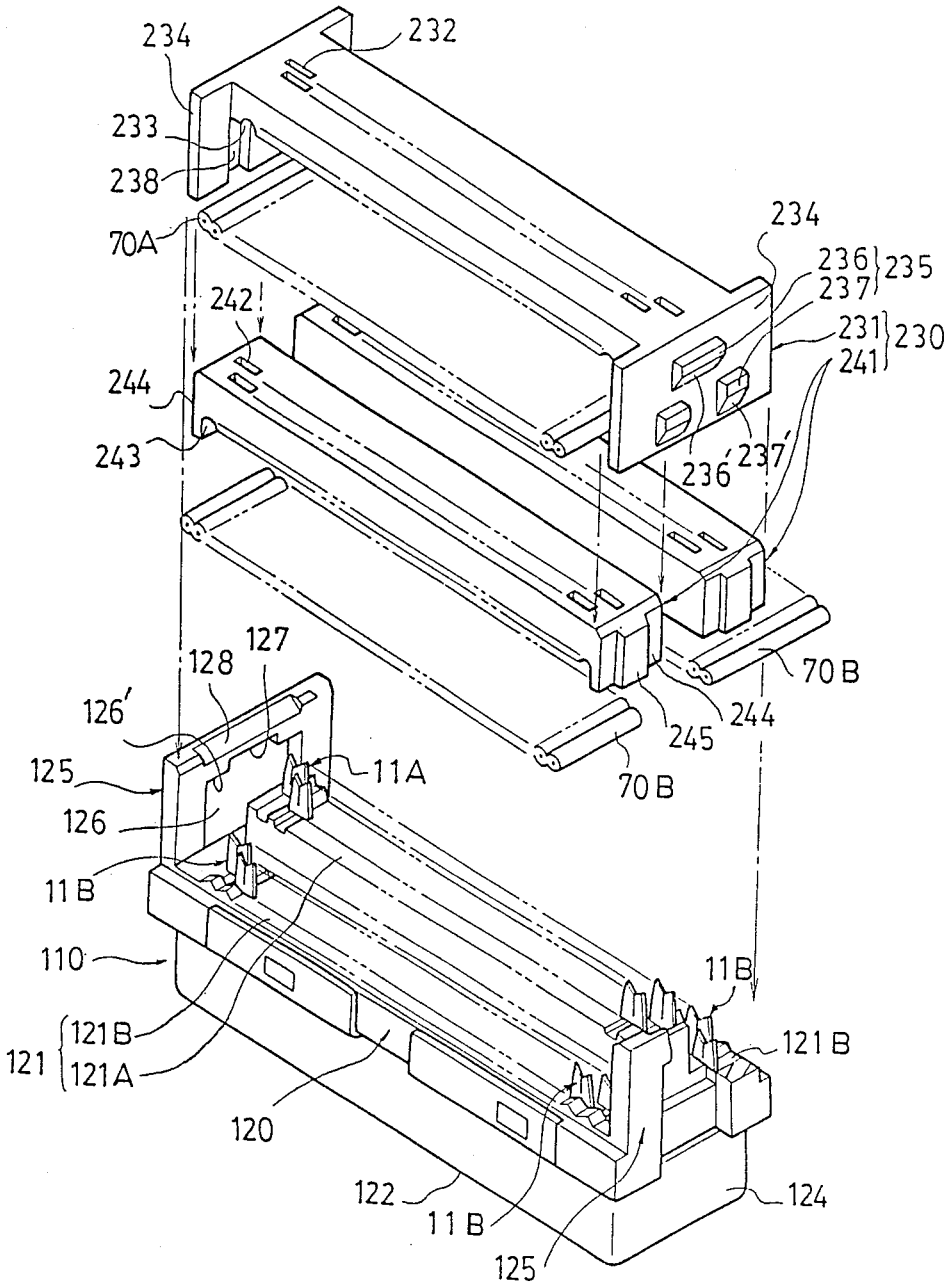
FIG. 11 is an exploded perspective view of another electrical connector according to the invention.

FIG. 11 shows another embodiment of an electrical connector according to the invention. In this embodiment, a pair of rows of shorter contacts is provided on each side of a pair of rows of longer contacts so that the first multiconductor flat cable 70A and a pair of the second multiconductor flat cables 70B may be terminated. A connector block 110 is substantially identical with the connector block 10 of FIG. 1 and, therefore, its detailed description will be omitted, except that its reference numerals are made by adding 100 to the corresponding reference numerals in FIG. 1. An insulating housing 120 has a pair of lower top surfaces 121B on either side of a higher top surface 121A. A pair of rows of shorter contacts 11B are aligned in a staggered fashion on each lower top surface 121B.

Figure 12:
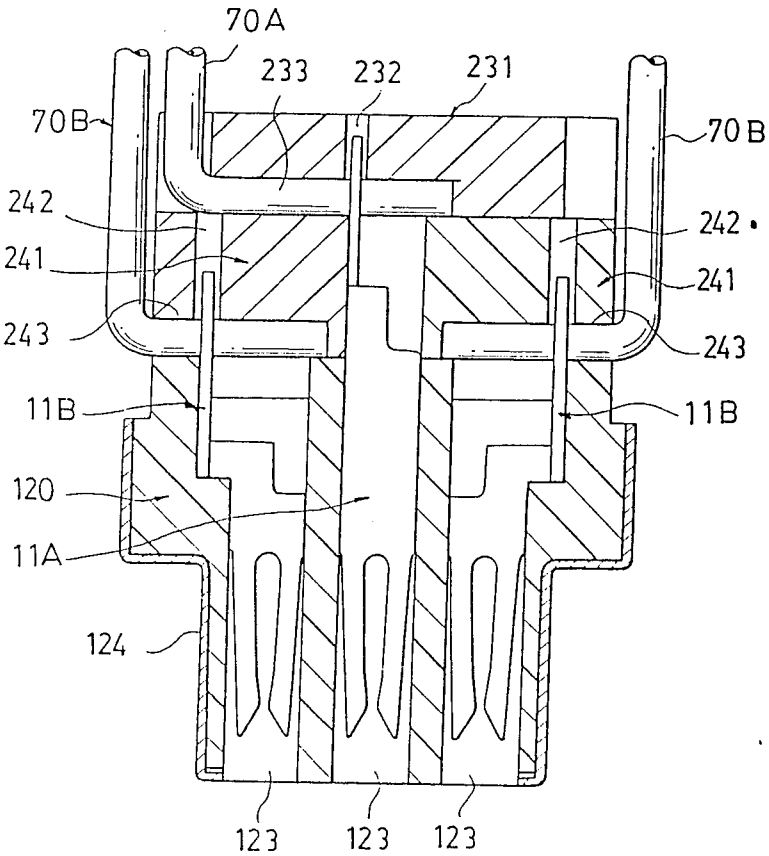
FIG. 12 is a sectional view of the electrical connector of FIG. 11 to which multiconductor flat cables have been terminated.

A retainer block 230 is substantially identical with the retainer block 30 of FIG. 1 and, therefore, its detailed description will be omitted except that its reference numerals are made by adding 200 to the corresponding reference numberals of FIG. 1. The retainer block 230 consists of the first retainer member 231 and a pair of the second retainer members 241 to be assembled on either side of the first retainer member 231. Each second retainer member 241 is mounted on each lower top surface 121B. Its structure may be identical with the retainer member 41 of FIG. 1. A method of terminating the three multiconductor flat cables 70A and 70B is apparent from the method of termination as described with respect to FIG. 1 and, therefore, its detailed description will be omitted. The electrical connector to which the three multiconductor flat cables have been terminated is shown in section in FIG. 12.

Figure 13:
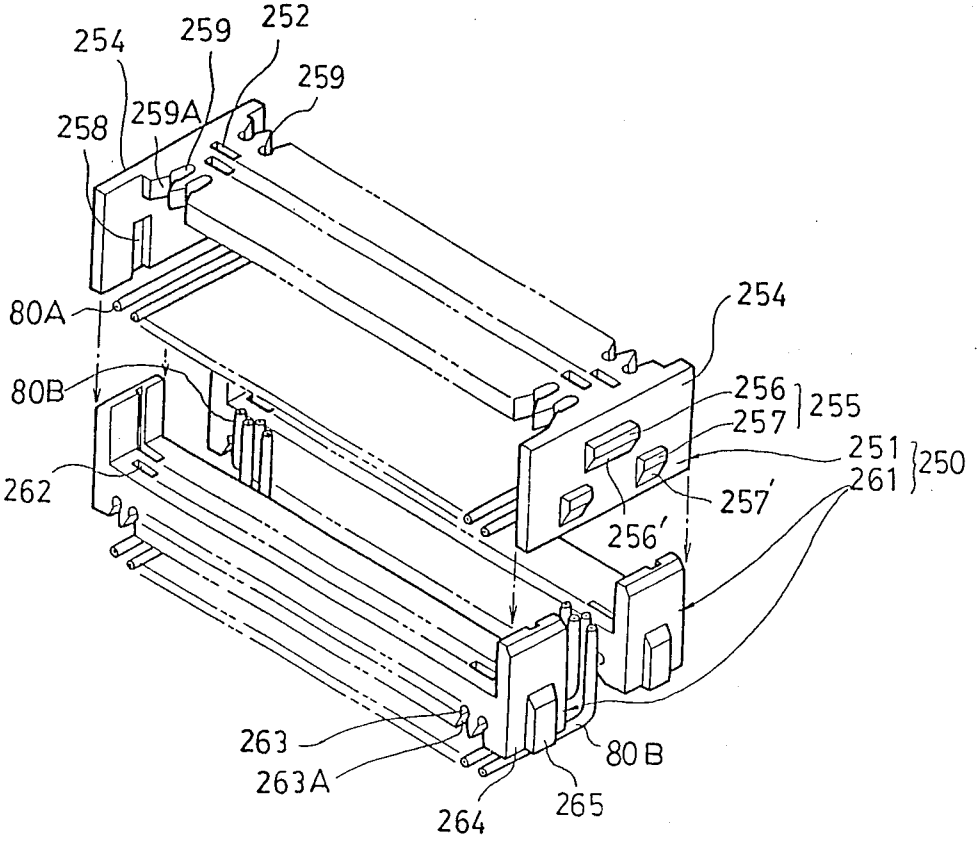
FIG. 13 is an exploded perspective view of still another retainer block according to the invention.

FIG. 13 shows still another embodiment of the retainer block of an electrical connector according to the invention. A retainer block 250 is assembled with the connector block 110 of FIG. 11 to terminate the first set of individual conductors 80A and a pair of the second sets of individual conductors 80B. This retainer block 250 is substantially identical with the retainer block 50 of FIG. 7 and, therefore, its detailed description will be omitted except that its reference numberals are made by adding 200 to the corresponding reference numerals of FIG. 7.

Figure 14:
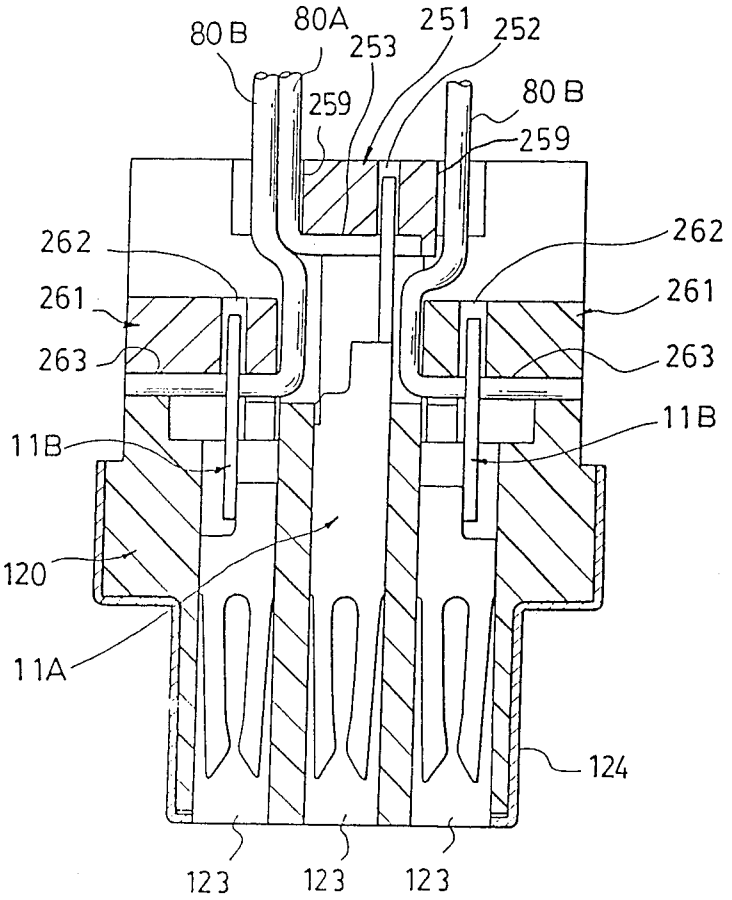
FIG. 14 is a sectional view of the electrical connector of FIG. 13 to which individual conductors have been terminated.

Briefly, this retainer block 250 consists of the first retainer member 251 and a pair of the second retainer members 261 disposed on either side of the first retainer member 251. Each of the second retainer members 261 is mounted on each lower top surface 121B of the connector block 110. Its structure may be identical with the second retainer member 61 of FIG. 7. A pair of rows of retention grooves 259 are provided on opposite sides of a pair of rows of receiving apertures 252 to hold vertically the individual conductors 80B which have been terminated to the contacts on the lower top surfaces 121B. Each retention groove 259 has a pair of sloped surfaces 259A for easy insertion of the conductor. A method of terminating the three sets of individual conductors 80A and 80B is apparent from the description made with respect to FIG. 7 and, therefore, its detailed description will be omitted. The electrical connector to which the individual conductors have been terminated is shown in section in FIG. 14.

The electrical connector according to the invention has the following advantages.

(1) A plurality of layers of multiconductor flat cables or individual conductors may first be set in the retainer block and then connected by pushing to the connector block so that the termination operation is made simple, thus reducing the manufacturing cost.

(2) A multiconductor flat cable or individual conductors may be mounted on the retainer member without using a press machine or tool. The retainer block loaded with multiconductor flat cables or individual conductors may be transported or stored either alone or by temporarily mounting on the connector block, thus making production on the assembly line, automatic termination, and mass production possible and reducing the manufacturing cost. The retainer block before complete termination permits a variety of types of multiconductor flat cables or individual conductors to meet a wide range of users' requirements and short delivery periods.

(3) The press machine or tool used may be of the ordinary type and be used only on the final step of the termination operation so that few press tools are necessary for the mass production, thus reducing the amount of investment in facilities.

(4) A single type of connector block is useful for terminating either type of multiconductor flat cables and individual conductors.

While a preferred embodiment of the invention has been described using specific terms, it is to be understood that changes and variations may be made without departing the spirit and scope of the invention as recited in the appended claims.

I claim:

1. An electrical connector for terminating at least two layers of conductors, which comprises:

an insulating housing having a higher top surface and a lower top surface and, on opposite ends, a pair of latch arms;

a plurality of longer contacts with their piercing portions projecting from said top surface;

a plurality of shorter contacts with their piercing portions projecting from said lower surface;

a first retainer member adapted to be mounted on said higher top surface and having on opposite ends a pair of end walls;

a second retainer member adapted to be mounted on said lower top surface;

means for temporarily mounting said first and second retainer members on said insulating housing in such a manner that a first layer of conductors may be held between said first retainer member and said piercing portions of said longer contact and a second layer of conductors may be held between said second retainer member and said piercing portions of said shorter contacts; and means for latching said first and second retainer members to said insulating housing so that said first and second layers of conductors are connected by piercing to said longer and shorter contacts, respectively, when said first and second retainer members are further pushed toward said insulating housing.

2. The electrical connector of claim 1, wherein said latch means comprises:

a first latch boss provided on an outside of said end wall of said first retainer member; and a latch notch provided in said latch arm of said insulating housing for engagement with said first latch boss.

3. The electrical connector of claim 1, wherein said temporarily mounting means comprises:

a pair of second latch bosses provided on said outside of said end wall below said first latch boss; and a pair of latch shoulders provided on either side of said latch notch for engagement with said second latch bosses.

4. The electrical connector of claim 1, wherein said second retainer member has on opposite ends a pair of guide rims and said first retainer member has on opposite ends a pair of guide channels for receiving said guide rims to bring together said second retainer member with said first retainer member.

5. The electrical connector of claim 4, wherein said guide channel has a latch protuberance therein for engagement with said guide rim to latch said second retainer member to said first retainer member.

6. The electrical connector of claim 1, wherein said first and second retainer members each have on their lower surface a plurality of parallel grooves for receiving said layer of conductors.

7. The electrical connector of claim 6, wherein said second retainer member has a pair of retention grooves for holding said layer of conductors.

8. The electrical connector of claim 7, wherein said parallel grooves each have a pair of sloped walls for easy reception of said conductors.

9. The electrical connector of claim 1, wherein said insulating housing has a second lower top surface on a side opposite to said lower top surface and a pair of rows of shorter contacts mounted therein.

10. An electrical connector for terminating first and second layers of conductors, which comprises:

an insulating housing having a higher top surface and a lower top surface and, on opposite ends, a pair of latch arms with a rectangular opening therein:

a plurality of longer contacts with their piercing portions projecting from said higher top surface;

a plurality of shorter contacts with their piercing portions projecting from said lower top surface;

a first retainer member adapted to be mounted on said higher top surface and having on opposite ends a pair of end walls, each of which has, on its outside, a first latch boss for engagement with said rectangular opening to latch said first and second retainer members to said insulating housing and a pair of second latch bosses below said first latch boss for engagement with said rectangular opening in said latch arm to temporarily put together said first and second retainer members with said insulating housing and, on its inside, a guide channel; and a second retainer member adapted to be mounted on said lower top surface and having, on opposite ends, a pair of guide rims to be fitted into said guide channels for bringing together said second retainer member with said first retainer member.

11. A method of terminating at least two layers of conductors to an electrical connector which includes an insulating housing having a higher top surface and a lower top surface, a pair of rows of longer contacts with their piercing portion projecting from said top surface, and a pair of rows of shorter contacts with their piercing portions projecting from said lower top surface, which comprises the steps of:

placing upside down first and second retainer members adapted to be mounted on said higher and lower top surfaces, respectively;

placing first and second layers of conductors on said first and second retainer members, respectively;

mounting said second retainer member on said first retainer member so that said first layer of conductors is held between them;

mounting said first and second retainer members on said insulating housing in such a manner that said first and second layers of conductors may be held adjacent to said piercing portions of said longer and shorter contacts, respectively; and pushing said first and second retainer members toward said insulating housing so that said first and second layers of conductors are connected by piercing to said longer and shorter contacts, respectively.

* * * * *